US005911385A

United States Patent [19]

Neifer et al.

[11] Patent Number: 5,911,385

[45] **Date of Patent: *Jun. 15, 1999**

[54] TAPERED ROLLER GUIDE FOR APPARATUS FOR PAYING OUT AN INSULATION SUPPORT SHEET

[75] Inventors: Don A. Neifer, Granville, Ohio; Dennis K. Wenrick, Oviedo, Fla.; Ernest J. Plant, Sequin, Tex.

[73] Assignee: Owens Corning Fiberglas Technology, Inc., Summit, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/645,994

[22] Filed: May 14, 1996

[51] Int. Cl.[6] ..... B65H 16/02; E04D 15/00

[52] U.S. Cl. ..... 242/557; 242/403; 52/749.12; 105/150

[58] Field of Search ..... 52/746.11, 749.12; 242/557, 403, 533.8; 105/150

[56] References Cited

U.S. PATENT DOCUMENTS

| | | | |
|---|---|---|---|
| 1,411,845 | 4/1922 | Dodge | 105/150 |
| 1,477,494 | 12/1923 | Hutchison | 105/150 X |
| 2,571,832 | 10/1951 | Chapin, Jr. | 105/150 X |
| 3,559,914 | 2/1971 | Alderman | 242/86.52 |
| 3,969,863 | 7/1976 | Alderman | 52/407 |
| 3,992,847 | 11/1976 | Heath | 52/749.12 |
| 4,047,345 | 9/1977 | Alderman | 52/404 |
| 4,047,346 | 9/1977 | Alderman | 52/407 |
| 4,068,446 | 1/1978 | Brueske | 52/747 |
| 4,075,807 | 2/1978 | Alderman | 52/407 |
| 4,147,003 | 4/1979 | Alderman | 52/309.8 |
| 4,222,212 | 9/1980 | Alderman | 52/749 |
| 4,434,601 | 3/1984 | Zellmer | 52/745 |
| 4,967,535 | 11/1990 | Alderman | 52/749 |
| 5,551,203 | 9/1996 | Alderman et al. | 52/749.12 |
| 5,634,407 | 6/1997 | Niederer | 105/150 |

*Primary Examiner*—John Q. Nguyen
*Attorney, Agent, or Firm*—C. Michael Gegenheimer; Curtis B. Brueske

[57] ABSTRACT

An apparatus for providing a roof structure having a plurality of purlins spaced apart from one another in a parallel arrangement is disclosed. The apparatus includes a carriage which is movable in a downstream direction along the length of the purlins. The carriage pays out a support sheet for support of insulation material as the carriage travels along the length of the purlins so that the support sheet depends from the top portion of adjacent purlins. The apparatus further includes at least one roller mounted on the carriage mounted to roll along the top portion of at least one purlin and thus support and guide the carriage along the downstream direction. The roller includes a frustum portion to hinder movement of the carriage in a direction lateral to the downstream direction and thus help to maintain the carriage in alignment with the purlins.

3 Claims, 3 Drawing Sheets

TAPERED ROLLER GUIDE FOR APPARATUS FOR PAYING OUT AN INSULATION SUPPORT SHEET

TECHNICAL FIELD

This invention relates to the construction of an insulated metal roof structure for use in commercial and industrial buildings.

BACKGROUND ART

Metal roof structures typically comprise a series of parallel rafter beams extending across the building in one direction and purlin beams parallel to each other mounted on top of the rafters extending in a direction normal to the rafters. The purlins are often joined together by support bracing or straps for extra support. Insulation material in long sheets is placed in the area between purlins. The sheets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer on insulation. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

The insulation material must be supported between the purlins beneath the hard roofing material. Various methods of supporting the insulation material have been used. Mounting straps or wire mesh which are attached to or draped over the purlins forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the sheet can support the insulation material and the lattice no longer serves any useful purpose.

Some systems dispense with the lattice and use the sheet itself to support the insulation material. The support sheet is draped from the adjacent purlins and the insulation material is placed on top of the support sheet. A carriage is typically used to aid in the dispensing of the support sheet wound on a roll. The carriage is positioned on top of the purlins and travels the length of the purlins during the roof construction. As the carriage travels the length of the purlins, the support sheet is draped across the purlins.

A safety netting which is attached to the purlins and rafters is often used to help prevent workers from accidentally falling through the open spaces of the roof structure. The netting is typically laid over the tops of the purlins and is covered over by the support sheet as the roof is constructed.

The carriages have been equipped with various structures which ride on top of the purlins and guide the carriage as it travels the length of the purlins. For example, a pair of beams having an L-shaped cross-section mounted on the bottom of the carriage and above two adjacent purlins have been used. The L-shaped beams are typically rigidly fixed to the carriage. The L-shaped beams have a laterally extending leg which slides on the top surface of the purlins, and a downwardly extending leg which contacts the side of the purlin, thus laterally guiding the carriage. The L-shaped beams, however, cannot be used with the safety netting because the netting will get caught between the beam and the top of the purlin. Also, because the purlin support bracing is generally attached towards the top portion of the purlins, the downwardly extending leg of the L-shaped beam often hits the support bracing. Also, bolts or rivets which extend up above the tops of the purlins may obstruct parts of the beam, such as the laterally extending leg of the L-shaped beam. In these cases, the carriage must be lifted up over the obstruction so that the carriage can continue moving along the length of the purlins.

Some prior art carriages are equipped with cylindrical rollers which roll along the top portions of the purlins. To prevent the carriage from moving laterally along the length of the purlins, the carriages are equipped with guides to maintain the carriage in alignment with the purlins. Typical guides used in the industry extend downwardly and are positioned adjacent the purlins, thereby contacting the side of the purlin to prevent the carriage from shifting laterally as it rolls on top of the purlins. These downwardly extending guides are also obstructed by the bracing connecting adjacent purlins. Although some guides have the ability to deflect out of the way either by manual operation or by automatic means, the guides often tear the safety netting if one is used on the roof. Also, the spacing of the purlins is not always accurate and the guides can jam the carriage between the purlins if the spacing of the purlins is shorter than specified.

DISCLOSURE OF THE INVENTION

There has now been invented an improved apparatus for providing a roof structure which includes a rotatably mounted roller having at least one frustum portion. The frustum portion is biased against the top portion of the purlins to help guide the carriage and prevent lateral movement so that the carriage stays in alignment with the purlins.

The present invention comprises an apparatus for use on a roof structure which includes a framework having a plurality of purlins spaced apart from one another in a parallel arrangement. The framework can be positioned horizontally or at a sloped angle with respect to the horizontal. The apparatus includes a carriage which is movable in a downstream direction along the length of the purlins. The carriage pays out a support sheet for support of insulation material as the carriage travels along the length of the purlins so that the support sheet depends from the top portion of adjacent purlins. A plurality of rollers mounted on the carriage support and guide the carriage along the downstream direction. The rollers are mounted to roll along the top portion of the purlins. The rollers have at least one frustum portion which maintains the carriage in alignment with the purlins, thereby hindering the carriage from moving in a direction lateral to the downstream direction.

In a specific embodiment of the invention, the roller has two frustum portions which are separated by a cylindrical portion. The cylindrical portion of the roller rollingly engages the horizontal upper surface of the top portion of the purlin. The frustum portions hinder lateral movement of the carriage by contacting the edge of the top portion of the purlin thereby hindering further lateral movement. Under conditions in which the spacing between purlins is not accurate, the frustum portions allow slight lateral movement of the carriage so that the carriage can continue to move along the downstream direction and still maintain alignment.

In another specific embodiment of the invention, the apparatus includes a pair of cooperating rollers in which the frustum portions are oriented in opposing directions, thereby in combination hindering the carriage from moving in either lateral direction.

DETAILED DESCRIPTION

Figure 1:
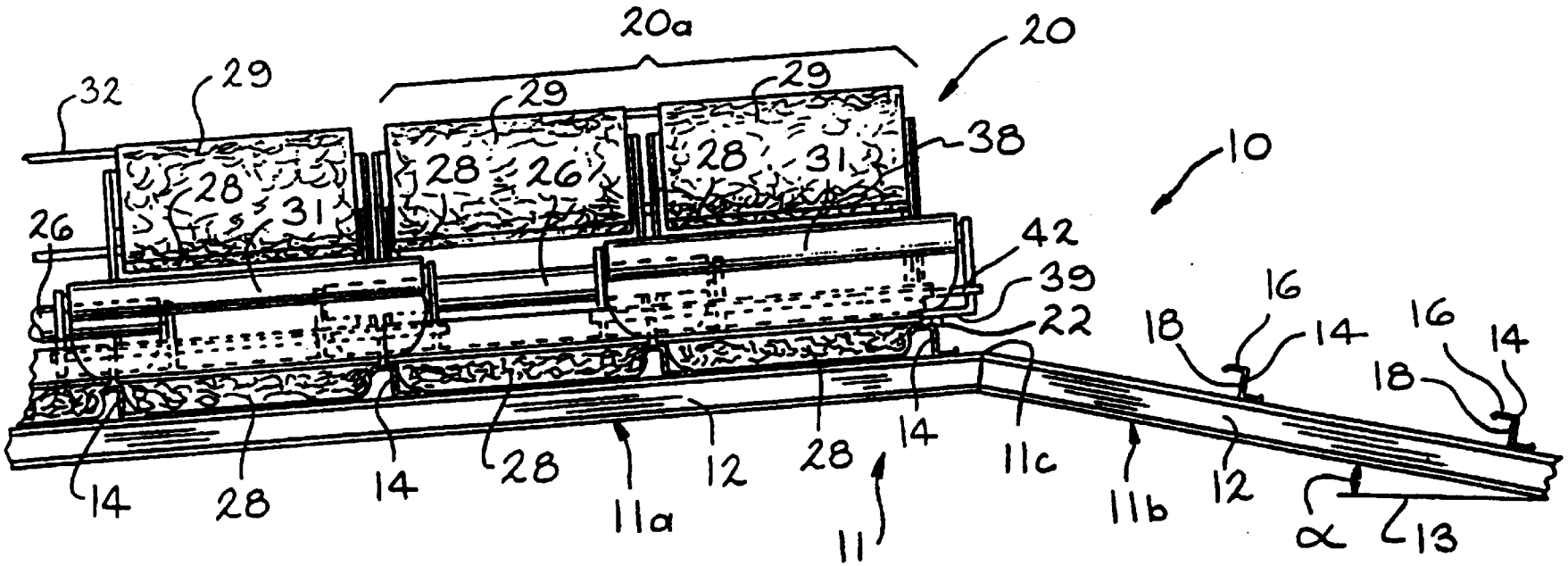
FIG. 1 is a schematic elevational end view of the carriage of the present invention on top of a roof structure.

There is illustrated in FIG. 1 a partially completed building roof structure, indicated generally at 10. The roof structure is supported by a building framework 11 which includes main rafter beams 12. The rafter beams on one half of the building are typically all parallel to each other, and the rafter beams on the other half of the building are typically parallel to each other. A plurality of purlins 14, spaced apart and arranged parallel to each other, are fastened on top of the rafters in a direction normal to the rafters. The building framework illustrated in FIG. 1 has two sloped roof sides 11*a* and 11*b* which are joined together forming a peak 11*c*. Thus, the framework 11 has successive adjacent purlins which are positioned lower than the peak as their distance from the peak increases. The top portions of the purlins approximately lie in a sloped plane which is at an angle with respect to a horizontal plane 13. The sloped roof sides generally provide for rain and snow drainage. A building framework having a horizontal roof surface can also be built with the apparatus of the present invention. The spacing of the purlins is typically 5 feet (1.82 m) on centers. The purlins have a generally Z-shaped cross-section and include a top portion 16 and a vertical portion 18. Roof structures may also be constructed from bar joists or trusses, and the invention as described herein will work equally well with purlins, bar joists or trusses. The use of the term "purlins" in this specification and claims includes not only traditional purlins, but also joists, trusses, and other similar structural members.

Figure 2:
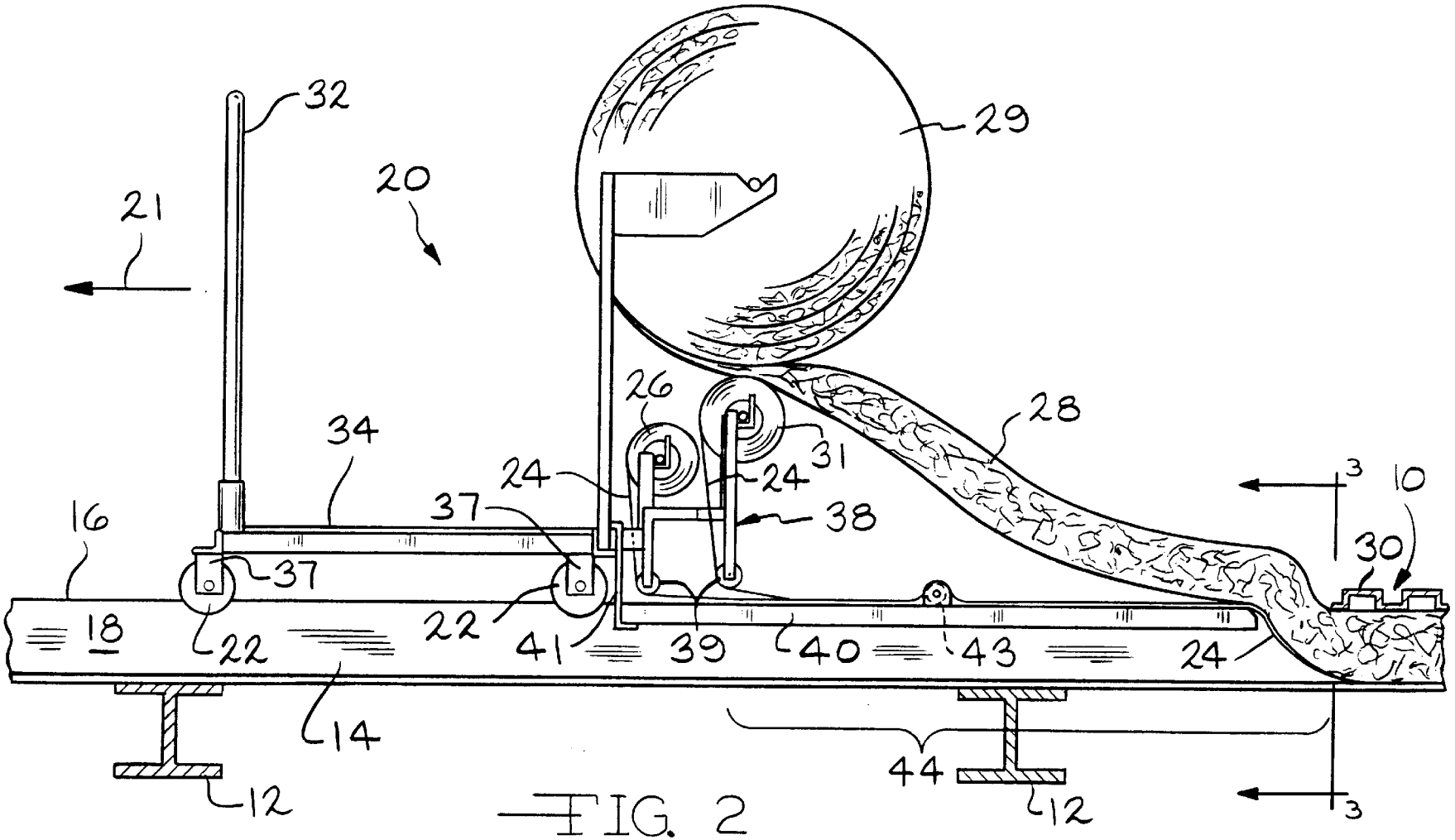
FIG. 2 is a schematic elevational side view of the carriage.

The roof structure is constructed by use of a carriage 20 which rides on the top portion of the purlins and travels along the length of the purlins in a downstream direction, represented by an arrow 21, as shown in FIG. 2. The carriage of the present invention includes rollers 22 to help keep the carriage aligned on top of the purlins. As the carriage is moved, a support sheet 24 is payed out from a roll 26. The support sheet is draped on top of adjacent purlins so that the support sheet depends from the top portion of the purlins. The support sheet supports a layer of insulation material 28 which is placed on top of the support sheet between the adjacent purlins. The insulation material is typically dispensed from a roll 29 but can be applied by any suitable manner, such as by applying insulation batts on top of the support sheet. In FIG. 1, the portion of the insulation material 28 immediately dispensed from the roll 29 is shown in section for clarity. After the insulation material has been placed on the support sheet, long sheets of hard roofing material 30, such as metal roof decking, are then attached to the top portion of the purlins over the support sheet and insulation. The hard roofing material can be fastened to the purlins in any suitable manner, such as by threaded fasteners or clips. The attachment of the hard roofing material presses down on the edges of the support sheet which are sandwiched between the top portion 16 of the purlins and the hard roofing material 30, so that the support sheet supports the insulation between the purlins.

Because the hard roofing material comes in long sheets, typically 30 to 35 feet (10.9 to 12.8 m), and the roofs generally have two sloped roof sides, it is customary to construct a first section of the roof structure along the width of the sloped roof side and then proceed along the length of the structure from one end to the other. The workers stand on the previously attached first section of the roof structure to assemble the next section of roof. The carriage travels along the length of the purlins and is moved by the workers as each new section of roof is assembled.

The carriage can be any length up to the width of the roof itself. As shown in FIG. 1, the carriage is comprised of a plurality of carriage sections 20*a* which can be joined together so that they span the entire width of the sloped section of the roof. The carriage is then propelled across the purlins by pulling means, such as winches (not shown), in the downstream direction 21 so that all the carriage sections move in unison. Because the support sheet is draped across the top portion of adjacent purlins, the total width of the support sheet is wider than the distance between the purlins. Therefore, adjacent support sheet rolls are not co-linear and must be slightly staggered. Typically, a carriage section 20*a* covers two purlin spans, i.e., about 10 feet (3.7 m) in length. Therefore, each carriage section preferably has both a leading roll 26 and a trailing roll 31 of insulation support sheet, one roll for each of two adjacent purlin spans. The edge of the support sheet from the trailing roll 31 will be draped on top of the edge of the support sheet from the leading roll 26 as the carriage moves in the downstream direction. Multiple identical carriage sections 20*a* having a leading and trailing roll can, therefore, be joined together, with every roll being staggered from an adjacent roll.

The carriage can be any suitable apparatus which moves along the top of the purlins and dispenses the support sheet. As seen from FIG. 2, the carriage 20 includes safety handrails 32 and a deck 34 for the worker to stand on while operating or moving the carriage. The rollers 22 are mounted on the carriage by a bracket 37, but could be mounted by any other suitable means. Preferably, the carriage is equipped with two rollers for each purlin, as shown in FIG. 2. The carriage also includes a framework 38 for mounting the rolls 26 and 31. In FIG. 1 the leading roll 26 is shown in the foreground, and the trailing roll 31 is shown in the background. Mounted on the framework are turning bars 39 which extend laterally across associated support sheets and are positioned slightly above the top portions 16 of the purlins 14 so as to direct the support sheet to a generally horizontal position.

Attached to the framework 38 is a plate 40 which extends from the carriage 20 in an upstream direction which is opposite the downstream direction 21. The plate supports the payed out portion of the support sheet and insulation material so that the support sheet does not drape downwardly and thereby pull the longitudinal edges of the support sheet off of the top portion of the purlins. If sufficiently built, the plate can be used for fall protection for the workers to prevent them from falling off the leading edge of the previously completed section of roof. The plate can be attached to the carriage by any suitable means, but preferably is attached to the framework by a plurality of hooks 41 which vertically extend from the plate and hang on the carriage, thus attaching one end of the plate to the carriage. The plate follows the carriage as the carriage moves along the length of the purlins. Preferably, the plate has wheels 43 which support the upstream end of the plate by rolling along the top portion 16 of the purlins 14. However, it is not required that the payed out support sheet be supported by the plate. The carriage could be modified so that the support sheet is payed out so that the support sheet is underneath the plate. Generally, the plate is located in a gap 44 which exists between the completed section of the roof structure 10 and the carriage 20. The plate hinders wind from blowing vertically through the gap 44 which could disturb the insulation material 28 and the support sheet 24. Although the insulation material is shown dispensed from a roll 29 mounted on the carriage, the insulation roll can also be laid directly on the plate.

Figure 3:
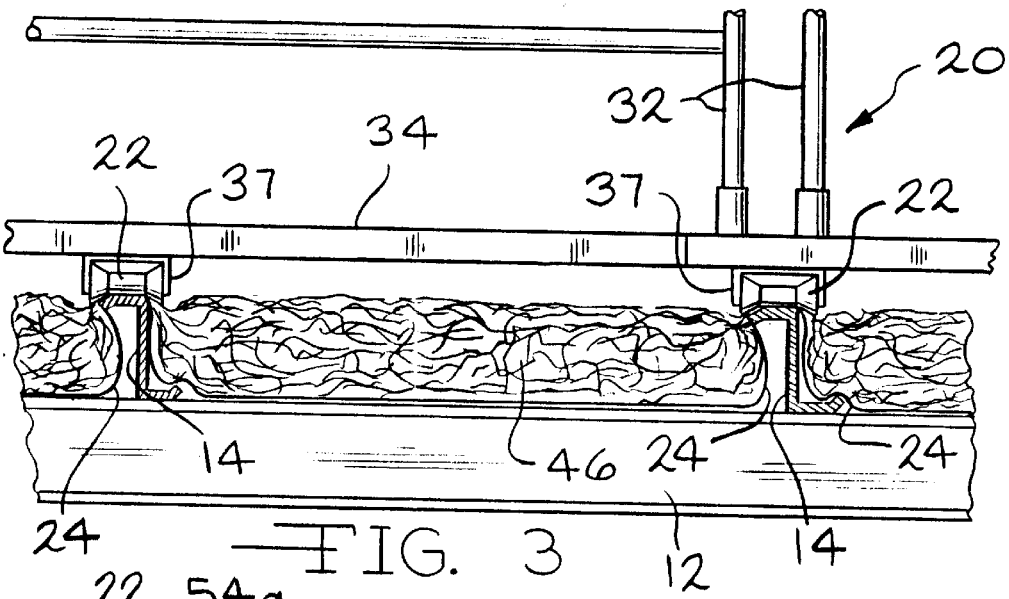
FIG. 3 is a schematic sectional view of the roof structure taken along line 3—3 of FIG. 2, in which the carriage is shown rolling along the tops of the purlins, and in which the plate and the framework of the carriage have been removed for clarity.

The space between the vertical portions 18 of adjacent purlins 14 defines an insulation cavity 46, as seen from FIG. 3. The insulation cavity has a generally rectangular cross-sectional shape. It is advantageous to fill out the insulation cavity uniformly with the insulation material without leaving relatively large gaps, thereby maximizing the insulating qualities of the roof structure. The purpose of the support sheet is to support the insulation material in the insulation cavity, but the support sheet can also be used as a vapor barrier, and for aesthetic purposes. A pleated support sheet which reduces the width of the rolls 26 and 31 can be used. The pleated support sheet unfolds as it is payed out in the insulation cavity. The support sheet can be of any suitable material for the stated purposes, such as vinyl or foil faced paper.

Figure 4:
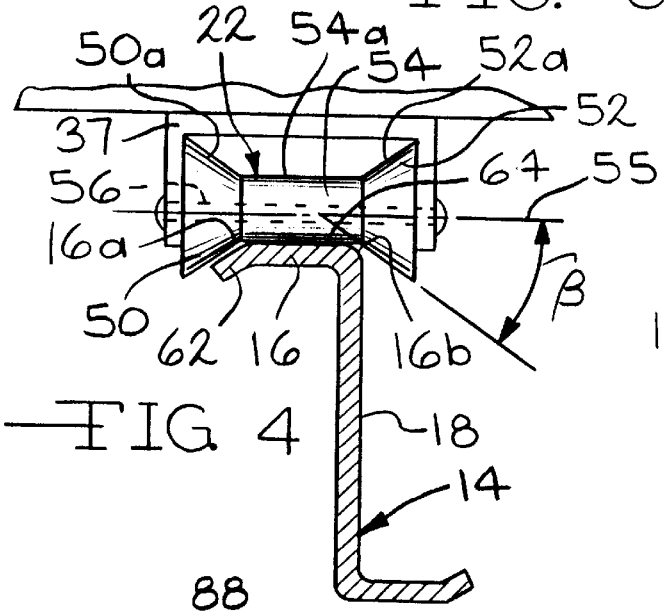
FIG. 4 is an enlarged schematic elevational view of a roller of the present invention shown engaging the top surface of a purlin.

Referring now to FIGS. 3 and 4, the rollers 22 have a pair of annular frustum portions 50 and 52 separated by a generally cylindrical portion 54. The frustum portions are tapered outwardly from an axis 55 of the cylindrical portion 54 by an angle beta. The angle beta is typically the same for both of the frustum portions 50 and 52. The cylindrical portion 54 has an outer cylindrical surface 54*a*, and the frustum portions 50 and 52 have outer conical surfaces 50*a* and 52*a*, respectively.

The roller can be rotatably mounted on the carriage by any suitable means. For example, as shown in FIG. 4, the roller is rotatably mounted on the bracket 37 by an axle 56. If desired, the roller can be mounted on bearings (not shown) to provide for low rolling frictional resistance, or can be mounted in any other suitable manner.

As shown in FIG. 4, the Z-shaped purlin 14, which is a commonly used beam in metal roof structures, typically has a top portion 16 with a flange 62 which angularly extends downward from the top portion 16. The top portion has an upper surface 64. The upper surface 64 extends between two corners or edges 16*a* and 16*b* of the top portion of the purlin. The frustum portions 50 and 52 of the rollers 22 are preferably angled at a sufficient angle so that the flange 62 does not interfere with the frustum portion 50. Preferably, the axial length of the cylindrical portion 54 of the roller 22 is approximately equal to or slightly greater than the width of the upper surface 64 of the top portion 16 of the purlin. If the axial length of the cylindrical portion 54 is too large, the carriage can move laterally with respect to the downstream direction 21 which can cause the longitudinal edges of the support sheet to misalign with the top portions of the purlins. The tapered design of the rollers 22 will also work equally well with other beam structures, such as I-beams, channel beams, tubular beams, and bar joists.

Under normal conditions in which the spacing between the purlins is accurate and consistent, the cylindrical portion 54 of the roller rides along the top of the purlin 14 as the carriage travels along the length of the purlins. When the carriage moves in a slight lateral direction, the edge 16*a* or 16*b* of the top portion 16 of the purlin 14 will contact the smaller diameter end of the frustum portion and will travel outwardly on the conical surface. The force from the weight of the carriage will urge the edge of the top portion of the purlin back toward the cylindrical surface of the cylindrical portion. Therefore, the frustum portions hinder any further lateral movement of the carriage and help to maintain the carriage in alignment with the purlins. When the carriage is on a sloped roof side, the weight of the carriage will urge the carriage in the lateral downward sloped direction. The associated frustum portion 50 or 52 of the roller 22 will help to maintain the carriage in alignment with the purlins, and hinder the carriage from slipping laterally. For steep sloped roof sides, the carriage can be equipped with side guides (not shown). The side guides are downwardly extending members which are positioned adjacent the side of the purlin and act as a stop to prevent the carriage from slipping off the purlin.

Under conditions in which the spacing between the purlins is not accurate, e.g., a couple of inches larger or smaller than the typical 5 feet spacing, the frustum portion 50 or 52 of the roller will "ride up" or "climb" on the associated edge 16*a* or 16*b* of the top portion 16 of the purlin 14. Specifically, the edge 16*a* or 16*b* will contact the conical surface 50*a* or 52*a* of the frustum portion 50 or 52, respectively, and the roller will continue to roll along the edge of the purlin, i.e., the frustum portion 50 or 52 will support the roller and carriage as the carriage moves along the length of the purlins. Thus, the frustum portions 50 and 52 allow slight lateral movement of the carriage so that the carriage can continue to move along the downstream direction. Normally, the inaccuracy of the purlin spacing is less than about one or two inches (2.5 or 5.0 cm), and the axial length of the frustum portion is dimensioned accordingly. Preferably, the bracket 37 is adjustably mounted on the carriage so that when the inaccuracy of the purlin spacing is larger than the axial length of the frustum portions, the bracket can be simply moved to accommodate the different purlin spacing.

The roller is preferably made of a material which does not have a high coefficient of friction. If the roller is made of a material having a high coefficient of friction, such as rubber, the roller tends to ride up on the edges of the purlin during use. Under circumstances where the edge 16*a* or 16*b* of the top portion of the purlin is contacting the conical surface of the frustum portion, the edge should be free to slide back onto the cylindrical surface. It has been found that a roller made of a hard plastic material having a coefficient of friction of about 0.1 is sufficient.

The angle beta of the conical surface 50*a* and 52*a* of the frustum portions 50 and 52 should be large enough to hinder the carriage from lateral movement when the spacing is accurate, yet small enough to allow the edge of the purlin to rollingly engage the conical surfaces 50*a* and 52*a* without hindering the carriage from traveling in the downstream direction 21. It has been found that an angle beta within the range from about 10 to about 30 degrees from the axis of the roller is preferable.

If the roof structure has a safety netting which is placed over the purlins along the entire roof, the tapered roller 22 simply rolls over the netting without cutting or snagging the netting.

Figure 5:
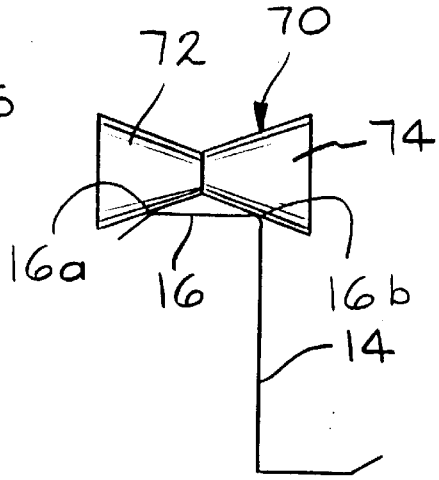
FIG. 5 is a schematic view of the an alternate embodiment of the roller.

FIG. 5 is a schematic illustration of an alternate embodiment of a roller 70 having two frustum portions 72 and 74 joined together. The roller 70 does not have a cylindrical portion. Each frustum portion 72 and 74 rollingly engages the associated edges 16*a* and 16*b*, respectively, of the top portion 16 of the purlin 14.

Figure 6:
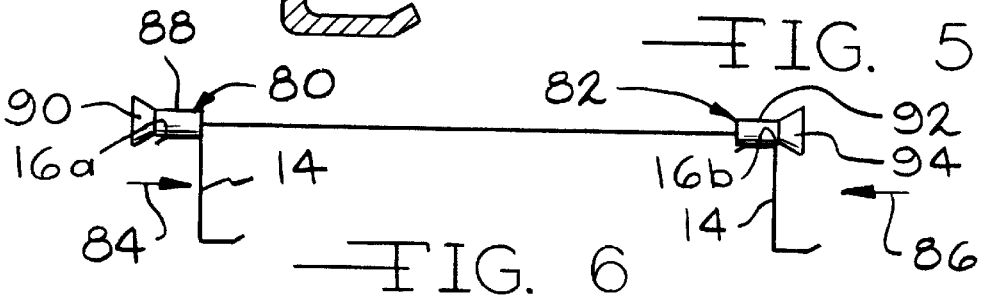
FIG. 6 is a schematic view of a pair of cooperating rollers which are oriented in opposing directions.

FIG. 6 is a schematic illustration of a pair of rollers 80 and 82 which cooperate to hinder the carriage (not shown) from moving in a first lateral direction 84 and a second lateral direction 86 with respect to the downstream direction. The roller 80 has a cylindrical portion 88 and a frustum portion 90 which extends outwardly to the left as shown in FIG. 6. The roller 82 has a cylindrical portion 92 and a frustum portion 94 which extends outwardly to the right as shown in FIG. 6. Therefore, the rollers have frustum portions which are oriented in opposing directions. The frustum portion 90 of the roller 80 tends to engage the edge 16*a* of associated purlin 14 to hinder the carriage from moving in the first lateral direction 84. The frustum portion 94 of the roller 82 tends to engage the edge 16*b* of associated purlin 14 to hinder the carriage from moving in the second lateral direction 86. Therefore, the combination of the two rollers 80 and 82 tends to hinder movement of the carriage in either the first or second lateral directions.

Figure 7:
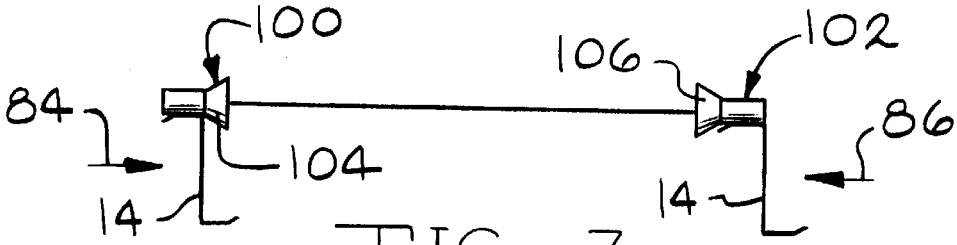
FIG. 7 is a schematic view of another embodiment showing a pair of cooperating rollers.

FIG. 7 is a schematic illustration of a pair of cooperating rollers 100 and 102, which function similarly to the rollers 80 and 82 of FIG. 6, to hinder the carriage (not shown) from moving in the first lateral direction 84 and the second lateral direction 86. The roller 100 has a frustum portion 104 which extends outwardly to the right. The roller 102 has a frustum portion 106 which extends outwardly to the left. The roller 100 tends to hinder movement of the carriage in the second lateral direction 86, while the roller 102 tends to hinder movement of the carriage in the first lateral direction 84.

It will be evident from the foregoing that various modifications can be made to this invention. Such, however, are considered as being within the scope of the invention. For example, it is to be understood that although the frustum portions of the present invention are shown as being conical frustum portions, the frustum portions could be formed in other shapes, such as hyperbolic, parabolic or irregularly-sloped frustum portions, and at least some of the advantages of the present invention would still be obtained thereby.

INDUSTRIAL APPLICABILITY

The invention can be useful in the construction of roof structures for commercial buildings.

We claim:

1. An apparatus for providing a roof structure having a plurality of purlins spaced apart from one another in a parallel arrangement, comprising:

a carriage movable in a downstream direction along the length of the purlins for paying out a support sheet for support of insulation material as the carriage travels along the length of the purlins;

a first roller mounted on the carriage for rolling on a first purlin, the first roller including a cylindrical portion and an annular frustum portion extending from only one end of the cylindrical portion of the first roller in a first lateral direction which is perpendicular to the downstream direction; and a second roller mounted on the carriage for rolling on a second purlin, the second roller including a cylindrical portion and an annular frustum portion extending from only one end of the cylindrical portion of the second roller in a second lateral direction which is opposite the first lateral direction, wherein the frustum portions of the first and second rollers taper outwardly from the respective cylindrical portions at a sufficient angle to enable the carriage to move in a direction lateral to the length of the purlins.

2. The apparatus of claim 1, wherein the first and second rollers are mounted on the carriage such that the frustum portions are positioned between the first and second purlins.

3. The apparatus of claim 1, wherein the frustum portions taper outwardly from the cylindrical portions at an angle within the range of from about 10 to about 30 degrees with respect to an axis defined by the cylindrical portion of each roller.

* * * * *